US007553384B2

(12) United States Patent
Groh

(10) Patent No.: US 7,553,384 B2
(45) Date of Patent: Jun. 30, 2009

(54) LOCAL HEAT TREATMENT FOR IMPROVED FATIGUE RESISTANCE IN TURBINE COMPONENTS

(75) Inventor: Jon Raymond Groh, Loveland, OH (US)

(73) Assignee: General Electric Company, Schnectady, NY (US)

( * ) Notice: Subject to any disclaimer, the term of this patent is extended or adjusted under 35 U.S.C. 154(b) by 414 days.

(21) Appl. No.: 11/339,915

(22) Filed: Jan. 25, 2006

(65) Prior Publication Data

US 2007/0169860 A1 Jul. 26, 2007

(51) Int. Cl.
*C22F 1/10* (2006.01)

(52) U.S. Cl. ..... 148/675

(58) Field of Classification Search ..... 148/675
See application file for complete search history.

(56) References Cited

U.S. PATENT DOCUMENTS

| | | | | |
|---|---|---|---|---|
| 3,871,928 | A * | 3/1975 | Smith et al. | 148/607 |
| 4,608,094 | A | 8/1986 | Miller et al. | 148/11.5 N |
| 4,820,356 | A | 4/1989 | Blackburn et al. | 148/12.7 N |
| 5,312,497 | A | 5/1994 | Mathey | 148/675 |
| 5,527,020 | A | 6/1996 | Ganesh et al. | 266/260 |
| 5,527,402 | A | 6/1996 | Ganesh et al. | 148/675 |
| 6,132,535 | A | 10/2000 | Okada et al. | 148/677 |
| 6,660,110 | B1 | 12/2003 | Gayda et al. | 148/675 |
| 6,974,508 | B1 * | 12/2005 | Gabb et al. | 148/428 |
| 2005/0056354 | A1 | 3/2005 | Groh et al. | 148/675 |

FOREIGN PATENT DOCUMENTS

| | | | |
|---|---|---|---|
| EP | 0421229 | A1 | 4/1991 |
| EP | 1201777 | A1 | 5/2002 |
| EP | 1524325 | A1 | 4/2005 |
| GB | 133354 | A | 10/1973 |

OTHER PUBLICATIONS

Superalloy. Dictionary.com. Dictionary.com Unabridged (v 1.1). Random House, Inc. http://dictionary.reference.com/browse/superalloy (accessed: Jul. 10, 2008).*

ASM International, Materials Park, Ohio, ASM Specialty Handbook: Nickel, Cobalt, and Their Alloys, "Heat Treating of Nickel Alloys", pp. 230-234, Dec. 2000.*

* cited by examiner

*Primary Examiner*—John P. Sheehan
*Assistant Examiner*—Jessee R. Roe
(74) *Attorney, Agent, or Firm*—Marcella R. Louke; William Scott Andes

(57) ABSTRACT

A method for locally heat-treating a gas turbine engine superalloy article to improve resistance to strain-induced fatigue of the article is disclosed. The method comprises providing a gas turbine engine superalloy article having a gamma prime solvus temperature; and locally over aging only a selected portion of the article to locally improve fatigue resistance at the selected portion of the article, wherein the local over age cycle includes heating at about 843° C. for about 3 to 4 hours.

6 Claims, 3 Drawing Sheets

LOCAL HEAT TREATMENT FOR IMPROVED FATIGUE RESISTANCE IN TURBINE COMPONENTS

FIELD OF THE INVENTION

The invention relates to localized heat treatments for superalloy articles to improve resistance to fatigue damage induced primarily in a strain induced field.

BACKGROUND OF THE INVENTION

Higher operating temperatures for gas turbine engines are continually sought in order to increase efficiency. However, as operating temperatures increase, the high temperature durability of the components within the engine must correspondingly increase. Material processing for durability in high temperature applications yields a coarser grain microstructure with less fatigue resistance than fine grain structures at temperatures below about 649° C. There are numerous instances where operating conditions experienced by a component place differing materials property requirements on different portions of the component. A turbine disk for a gas turbine engine is an example of a type of component where tailored mechanical behavior in various portions of the article is preferred. Such disks are typically made from nickel-base superalloys, because of the temperatures and stresses involved in the gas turbine cycle. In the hub portion where the operating temperature is somewhat lower, the limiting material properties are often tensile strength and low-cycle fatigue resistance, which are superior in the fine grain condition up to about 649° C. In the rim portion where the operating temperature is higher because of the proximity to combustion gases, resistance to creep and hold time fatigue crack growth (HTFCG) is often the limiting material property. HTFCG is the propensity in a material for a crack to grow under cyclic loading conditions where the peak tensile strain is maintained at a constant value for an extended period of time. Therefore, processing the entire article to the damage-tolerant, coarse grain structure necessary for the high temperature rim location can result in a sacrifice of fatigue life at conditions encountered in the relatively cool-running bore.

The fatigue resistance of rotor alloys is an important measure in the design of turbine engine hardware. Conflicting requirements of other sizing criteria, such as rotor burst resistance, weight and available space, pose restrictions on the ability to satisfy fatigue life criteria. Life limiting locations are often localized to a zone or feature within a relatively long life region. An example is the inside diameter of a high pressure turbine disk bore at the mid-axial position due to constraint imposed by the mass of bore metal.

Accordingly, a process to locally improve fatigue performance of components without significantly affecting the overall balance of properties is needed.

BRIEF DESCRIPTION OF THE INVENTION

Applicant has advantageously determined a heat treatment of the limiting location at a temperature and time that causes local over age of the alloy to provide improved fatigue resistance. Over age of the entire component, or even a large portion of the component, is neither required nor desired as the fatigue benefit is not required over the entire region.

In accordance with one embodiment of the invention, a method for locally heat treating a gas turbine engine superalloy article to improve resistance to strain-induced fatigue of the article is disclosed. The method comprises providing a gas turbine engine superalloy article having a gamma prime solvus temperature; and locally over aging only a selected portion of the article to locally improve fatigue resistance at the selected portion of the article, wherein the local over age cycle includes heating at about 843° C. for about 3 to 4 hours.

In accordance with another embodiment of the invention, a method for locally heat treating a gas turbine engine superalloy article to improve resistance to strain-induced fatigue of the article is disclosed. The method comprises providing a gas turbine engine nickel-based superalloy article having a gamma prime solvus temperature; and processing the superalloy article below the gamma prime solvus temperature to achieve a fine grain microstructure below about 16 μm average grain diameter, followed by heat treating above the gamma prime solvus temperature to achieve a coarse grain microstructure above about 16 μm. The method further comprising then quenching or fan cooling the superalloy article having the coarse grain microstructure to ambient, followed by a stabilization at about 843° C. for about 3 to 4 hours, followed by air cool to ambient, followed by heat treatment at about 760° C. for about 8 hours, followed by air cool to ambient, followed by local overage at about 843° C. for about 3 to 4 hours at a selected region of the article requiring a strain fatigue benefit, and machining.

Other features and advantages will be apparent from the following more detailed description and drawings, which illustrate by way of example the principles of the invention.

DETAILED DESCRIPTION OF THE INVENTION

While various embodiments are described herein it will be appreciated from the specification that various combinations of elements, variations or improvements therein may be made by those skilled in the art, and are within the scope of the invention. More particularly, while reference below is to a turbine disk, one will appreciate that the localized heat treatments disclosed herein are applicable to other superalloy articles including, but not limited to, disks, seals and shafts of gas turbine engine components. Similarly, while reference is often made herein to nickel-base substrates, other substrates including, but not limited to, precipitation hardened iron-base and nickel-iron-base superalloy substrates may also be suitable.

The operating temperatures in the rim portion of a disk frequently exceed about 1200° F. (649° C.), and creep and HTFCG resistance are generally the limiting material properties. Thus, a metallurgical structure providing high resistance to creep and HTFCG is preferred in the rim portion. A coarse grain structure, which may be obtained through a supersolvus heat treatment, can provide greater resistance to creep and HTFCG than the fine grain structure frequently selected for the hub portion of the disk. The combination of structures which provides both high tensile strength and low cycle fatigue in the hub portion and high resistance to creep and HTFCG in the rim is thus desired. Heat treatment methods are disclosed in U.S. Pat. Nos. 5,527,020 and 5,527,402 also of common assignee herewith, the contents of which are hereby incorporated by reference. Disclosed therein is a dual solution heat treatment that maintains the bore below the critical gamma prime solvus temperature while the rim is above the γ'-solvus. This advantageously results in the coarse grain rim required for high temperature and a fine grain bore for the lower temperature properties. Although this process is effective, complexities such as increased equipment cost, control of the transient zone, and less damage tolerant characteristics of a fine grain microstructure in the bore may arise. Further heat treat methods are also described in U.S. Pat. Nos. 5,312,497 and 6,660,110.

Additionally, flange bolthole features may be life limiting and require special configuration to reduce the stress concentration at the top and bottom of the hole, assuming loading is primarily in the circumferential direction. However, this method of stress reduction can require additional cost and cycle time relative to that of a standard, round bolthole. Overage of the flange region provides a process that may allow the use of a standard, round hole configuration resulting in a cost advantage.

Figure 2:
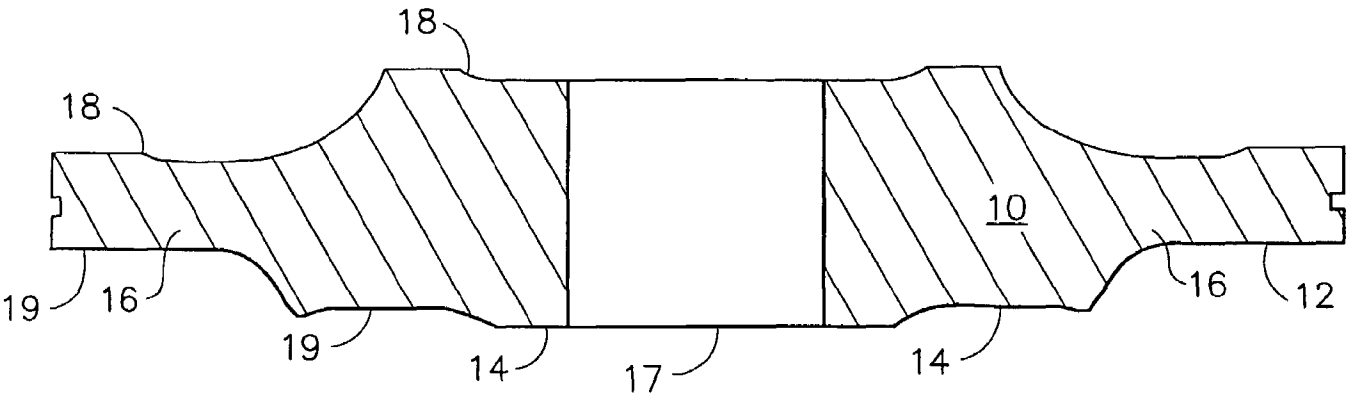
FIG. 2 schematically shows a local bore location of a stage 1 disk, for heat treatment by embodiments of the invention.
Figure 1:
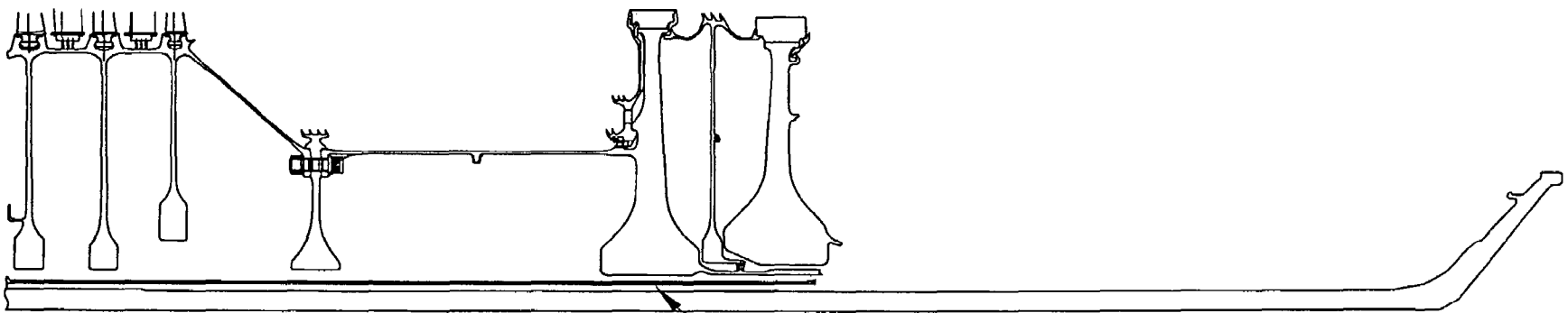
FIG. 1 is a cross sectional view of a gas turbine engine rotor, including turbine disks.

Thus, Applicant has determined a process to locally improve fatigue performance without significantly affecting the balance of properties. For example, FIG. 1 shows the local bore location 8 of a stage 1 turbine disk, which may be heat treated in accordance with the embodiments described herein to improve the fatigue performance. Referring now to FIG. 2, a cross section of a turbine disk, which may be heat treated in accordance with embodiments of the invention, is shown generally by 10. The disk 10 comprises a rim portion 12, a hub portion 14, and a connecting or web portion 16. A central bore hole 17 through the hub portion 14 is generally a feature of the disk 10 to enable internal passage of a concentric shaft and facilitates heat treatment. The disk 10 also comprises a first face 18 and a second face 19, each of which extends over the rim portion 12, hub portion 14, and web portion 16 on opposing sides of the disk.

The articles heated in accordance with embodiments of the invention, including disk 10 of a gas turbine engine, can comprise any suitable material, such as conventionally cast and wrought nickel base superalloys, which are hardened by precipitation of the gamma-prime phase. Similarly, Applicant's heat treatments are useful when the starting superalloy material is a powdered material part (p/m), such as p/m turbine disks fabricated by HIP or consolidation to billet followed by deformation in an isothermal forge press. Both conventional and the p/m processing are typically processed to yield a fine-grained forging, which can be heat treated in accordance with embodiments of the invention.

Typically, the operating temperature in, for example, the hub portion is below about 1200° F. (649° C.). In this temperature range, representative disk materials, such as Rene '95, have ample creep and HTFCG resistance, and the limiting materials properties are tensile strength and low-cycle fatigue resistance. René 95 is a well known nickel base superalloy having a nominal composition, in weight percent, of 14% Cr, 8% Co, 3.5% Mo, 3.5% W, 3.5% Nb, 3.5% Al, 2.5% Ti, 0.15% C, 0.01% B, 0.05% Zr, balance Ni and incidental impurities. Processing of this alloy typically incorporates a solution heat treatment below the nominal 2110° F. (1154° C.) γ' solvus, cooled via fan air or oil quench, then aged at a temperature well below the γ' solvus, typically 1400° F. (760° C.). The resulting average grain size is finer than about ASTM 9 (<16 μm).

In damage tolerant alloys such as René 104 for applications above about 1200° F. (659° C.), or to improve fatigue crack growth resistance, the disk forging 10 may be super-solvus solution heat treated above the γ' solvus (similar to that of René 95) to dissolve the precipitate and coarsen average grain microstructure to about ASTM 4-9 (90-16 μm). Solution and subsequent stabilization and/or age heat treatments below the γ' solvus (about 760-850° C.) may employ a nominally isothermal heat treatment of the entire disk.

The composition of the afore-referenced alloy René 104, in weight %, is nominally 20.5 Co, 11.0 Cr, 3.7 Mo, 2.0 W, 3.4 Al, 3.6 Ti, 0.9 Nb, 2.4 Ta, 0.05 Zr, 0.04 C, 0.03 B, balance Ni.

The localized heat treatment, according to embodiments of the invention, can heat treat fatigue-limited locations of the afore-referenced articles at a temperature that causes local over age of the alloy to advantageously provide improved fatigue resistance without adversely affecting the coarsened grain structure. More particularly, local heating of the alloy to a temperature lower than the γ'-solvus, but higher than a final (bulk) age temperature can be effective to cause the desired over age condition by further coarsening of γ' precipitates. For gamma-prime precipitation strengthened nickel-base alloys such as René 104 and René 95, a satisfactory overage cycle is about 1550° F. (843° C.) for about 3 to 4 hours.

The foregoing cycle may be achieved and controlled by using combinations of commercially available induction coils, quartz lamps, and insulation wraps to provide and contain the energy necessary to achieve metal temperatures that can be monitored using optical pyrometer or strap-on thermocouples to measure metal temperatures. A feedback loop can be employed to maintain a constant, nominally uniform temperature in the location requiring over-age heat treatment.

Advantageously, no substantial change in grain size results from the foregoing heat treatment and damage tolerance is not adversely affected as neither the grain size nor elastic modulus is significantly affected during the over-age cycle. Greater fatigue life results from the relatively low yield strength material, possibly showing less sensitivity to fatigue initiation at second phase particles, such as primary and secondary carbides. The over-aged material is also expected to enable easier cross-slip of cyclic deformation across grain and twin boundary microstructural features, which will delay crack initiation.

Embodiments of the invention will be further described by the following non-limiting examples.

EXAMPLE 1

Figure 3:
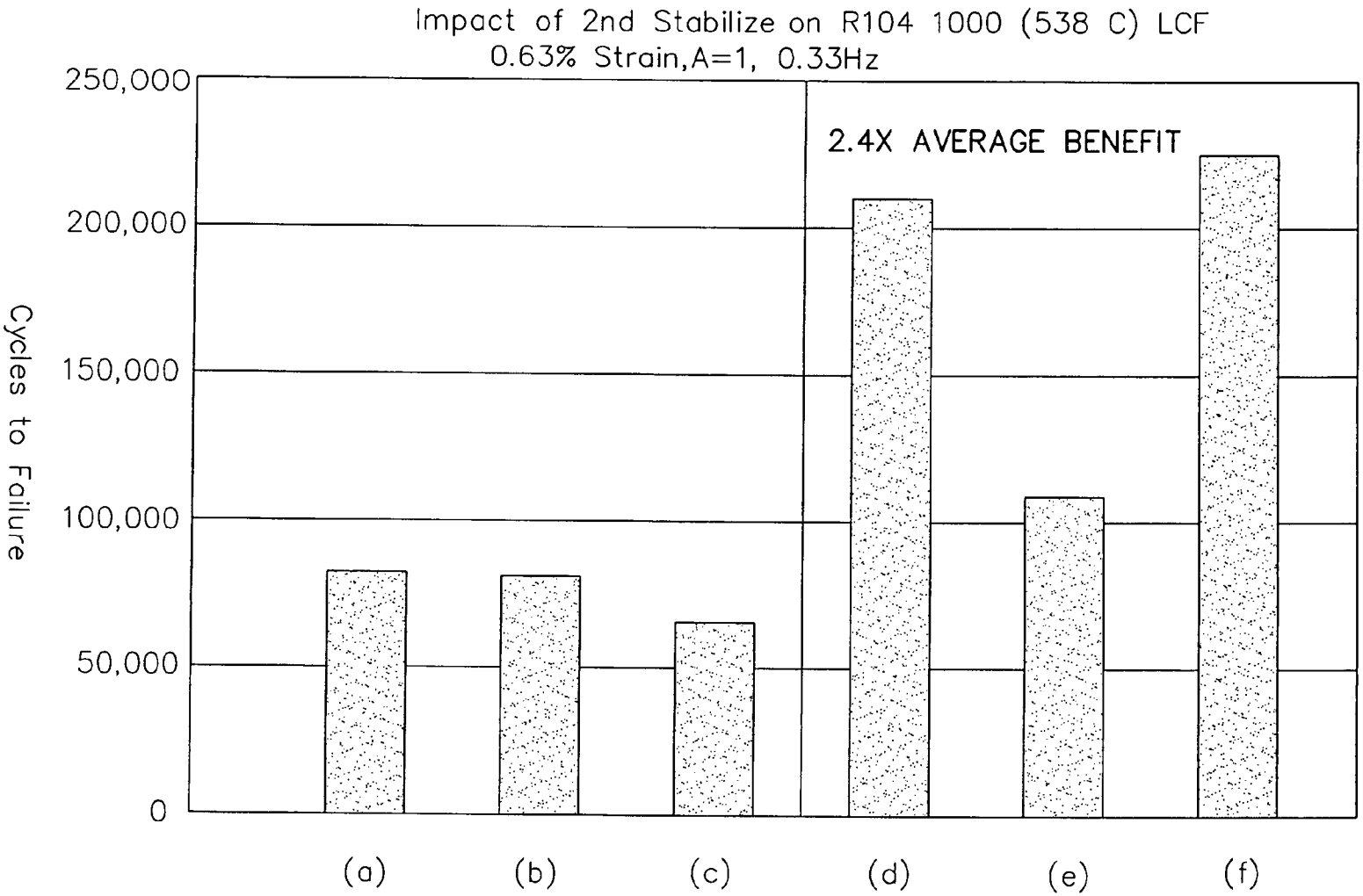
FIG. 3 is a graph of mechanical test data demonstrating the improved low cycle fatigue resistance of embodiments of the invention.

An average 2.4× benefit in low cycle fatigue behavior of René 104 samples when tested in strain control at 1000° F. (538° C.) has been advantageously demonstrated, as shown in FIG. 3. In particular, a René 104 forging was heat treated to a standard schedule of super-solvus solution, quench, stabilize and age precipitation heat treatment. A series of six test bar blanks measuring approximately 4" in length were excised using the same orientation and similar location to minimize the effect of microstructural variables from the experiment. Each blank was machined to a nominal 0.8" diameter×4" length gage blank and inertia welded to Alloy 718 ends. Three of the inertia weldments were retained in this condition and identified as a, b, and c. The remaining weldments were labeled d, e, and f and were instrumented with thermocouples on each René 104 gage.

Each of weldments d, e, and f were inserted into an induction coil as used for metallic specimen mechanical testing. Each bar was individually heat treated at about 843° C. for about 4 hours and allowed to air cool. All six specimens were then finish machined using low stress grind of specimen gages. Each was then fatigue tested at 1000° F. (53° C.) in longitudinal strain-control. Each test was cycled to failure at 20-30 cycles per minute.

The results of René 104 baseline samples, a-c, and the over-aged samples, d-f, are set forth in FIG. 3. Significantly, the average benefit of triplicate back to back tests was a 2.4× benefit in comparison to the baseline René 104 behavior.

Figure 4:
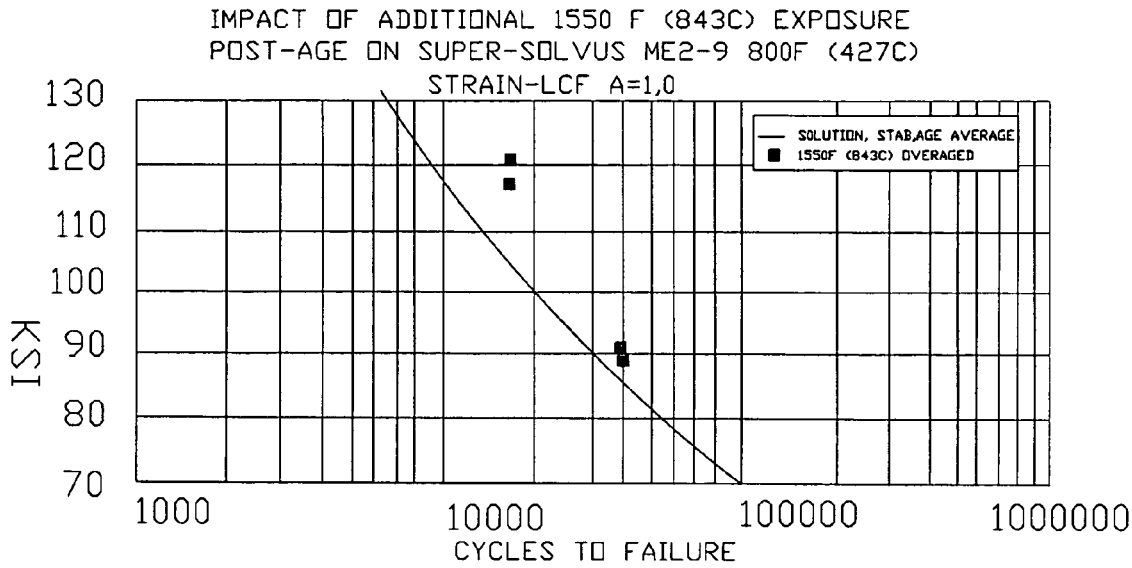
FIGS. 4-5 also graphically demonstrate the improved low cycle fatigue results of embodiments of the invention.
Figure 5:
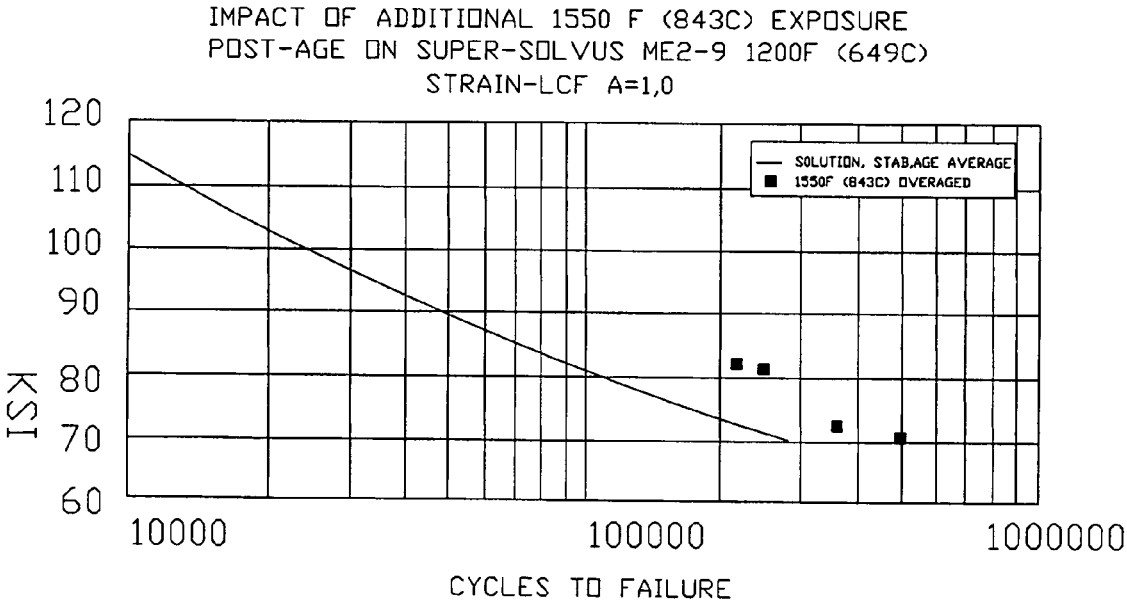

FIGS. 4 and 5 also advantageously demonstrate the improved results of employing an over age heat treatment of bulk alloy ME 2-9 prior to inertia weld into 718 buttons. This material is similar to René 104 with the exception of, 20.0 wt.% Co and 2.1 wt.% Ta. This material was also heat treated to a super-solvus solution, quenched stabilized and aged from a single forging. The curves show the average behavior of the as-heat treated forging, with the individual data points determined for the same material providing about a 1550° F. (843° C.)/3 hour overage heat treatment prior to machining into a fatigue specimen. Testing was also strain-control, 20-30 cpm cycling at 1200° F. (649° C.) and 800° F. (247° C.) as indicated. The data plotted in FIG. 4 are converted from the tested strain control to alternating pseudostress (PsAlt=(% strainX-Elastic ModulusX10)/2). Observed fatigue life improvement was 2.0-2.5 and 1.1-1.7X, respectively.

Advantages of embodiments of the invention include the ability to improve strain-control fatigue lives of structures, such as damage tolerant nickel-based structures, by local over-age. The desired coarse grain structure is not adversely altered by the heat treatment embodiments of the invention, thereby allowing the article to retain fatigue crack growth resistance characteristics of damage tolerant structures. Further advantages include an inexpensive method to locally improve fatigue life. Still further advantages include retention of the mechanical behavior balance needed in the rest of the article as required to for the application outside of the fatigue critical zone. It is feasible that local over-age heat treatments could also be used to tailor multiple locations on a single component if deemed necessary.

Advantageously, as described above, embodiments of the invention can provide a method comprising providing a gas turbine engine nickel-base superalloy forging processed below the gamma prime (γ') solvus temperature; and heat treating the article to achieve a structure having a damage tolerant, coarse grain by solution heat treatment above the γ'-solvus (e.g. >about 2110° F. for René 104) to cause grain growth to a creep and damage tolerant microstructure and quenching to achieve a fine re-precipitation of γ' while preventing quench cracks. The method can further comprises stabilization and/or age heat treatments of the entire article at a temperature below the γ'-solvus to relieve strains from the quench and to further develop the γ' morphology and distribution required for processing to achieve a mechanical property balance characteristic of the alloy; finish or near-finish machining the article; and locally over aging only a selected portion of the article to locally improve strain-control fatigue resistance at the selected portion of the article, wherein the local over age cycle can include heating at a temperature above that of final age, but substantially below the γ' solvus. Processing via this method can advantageously result in an average grain size in the range of ASTM 4-9 (90-16 μm).

While various embodiments are described herein, it will be appreciated from the specification that various combinations of elements, variations or improvements may be made by those skilled in the art, and are within the scope of the invention. For example, while emphasis is placed on improving the fatigue resistance damage tolerant microstructures, subsolvus precipitation hardened materials are applicable, as well.

What is claimed is:

1. A method for locally heat treating a gas turbine engine superalloy article to improve resistance to strain-induced fatigue of the article comprising:

providing a gas turbine engine superalloy article having a gamma prime solvus temperature, wherein the superalloy article has a nominal composition in weight percent of 20.5Co, 11Cr, 3.7Mo, 2.0 W, 3.4Al, 3.6Ti, 0.9 Nb, 2.4 Ta, 0.05Zr, 0.04C, 0.03 B, balance Ni or a nominal composition in weight percent of 8Co, 14Cr, 3.5Mo, 3.5W, 3.5Al, 2.5Ti, 3.5 Nb, 0.15C, 0.01B, balance Ni or a nominal composition in weight percent of 20Co, 11Cr, 3.7Mo, 2.0 W, 3.4Al, 3.6Ti, 0.9 Nb, 2.1 Ta, 0.05Zr, 0.04C, 0.03 B, balance Ni; and locally over aging in a local over age cycle only a selected portion of the article as opposed to the entire article to locally improve fatigue resistance at the selected portion of the article, wherein the local over age cycle includes heating at about 843° C. for about 3 to 4 hours.

2. The method of claim 1 comprising, prior to the locally over aging, processing the superalloy article below the gamma prime solvus temperature to achieve a fine grain microstructure below about 16 μm followed by heat treating above the gamma prime solvus temperature to achieve a coarse grain microstructure above about 16 μm.

3. The method of claim 2 further comprising quenching the superalloy article having the coarse grain microstructure, followed by a stabilization and a precipitation heat treatment at a temperature below the gamma prime solvus temperature followed by machining the article.

4. The method of claim 3 comprising air cool to ambient following the local overage at about 843° C. for about 3 to 4 hours.

5. The method of claim 1, wherein the superalloy article is a nickel based turbine disk and the selected portion is an inner diameter of a disk bore or a bolt flange.

6. A method for locally heat-treating a gas turbine engine superalloy article to improve resistance to strain-induced fatigue of the article comprising:

providing a gas turbine engine nickel-based superalloy article having a gamma prime solvus temperature, wherein the superalloy article has a nominal composition in weight percent of 20.5Co, 11Cr, 3.7Mo, 2.0 W, 3.4Al, 3.6Ti, 0.9 Nb, 2.4 Ta, 0.05Zr, 0.04C, 0.03 B, balance Ni or a nominal composition in weight percent of 8Co, 14Cr, 3.5Mo, 3.5W, 3.5Al, 2.5Ti, 3.5 Nb, 0.15C, 0.01B, balance Ni or a nominal composition in weight percent of 20Co, 11Cr, 3.7Mo, 2.0 W, 3.4Al, 3.6Ti, 0.9Nb, 2.1 Ta, 0.05Zr, 0.04C, 0.03 B, balance Ni; and processing the superalloy article below the gamma prime solvus temperature to achieve a fine grain microstructure below about 16 μm average age diameter, followed by heat treating above the gamma prime solvus temperature to achieve a coarse grain microstructure above about 16 μm;

followed by quenching or fan cooling the superalloy article having the coarse grain microstructure to ambient, followed by a stabilization at about 843° C. for about 3to 4 hours, followed by air cool to ambient, followed by heat treatment at about 760° C. for about 8 hours, followed by air cool to ambient; followed by a local overage at about 843° C. for about 3 to 4 hours only in a selected region of the article requiring a strain fatigue benefit, as opposed to the entire article, and machining.

* * * * *